US010352606B2

(12) United States Patent
Hellmann et al.

(10) Patent No.: US 10,352,606 B2
(45) Date of Patent: Jul. 16, 2019

(54) COOLING SYSTEM

(75) Inventors: Sascha Hellmann, Rheinzabern (DE); Hans-Joachim Huff, Mainz (DE)

(73) Assignee: CARRIER CORPORATION, Farmington, CT (US)

( * ) Notice: Subject to any disclaimer, the term of this patent is extended or adjusted under 35 U.S.C. 154(b) by 877 days.

(21) Appl. No.: 14/396,284

(22) PCT Filed: Apr. 27, 2012

(86) PCT No.: PCT/EP2012/057812

§ 371 (c)(1),
(2), (4) Date: Dec. 17, 2014

(87) PCT Pub. No.: WO2013/159827

PCT Pub. Date: Oct. 31, 2013

(65) Prior Publication Data

US 2015/0233624 A1 Aug. 20, 2015

(51) Int. Cl.
*F25B 7/00* (2006.01)
*F25B 40/02* (2006.01)
(Continued)

(52) U.S. Cl.
CPC ..... *F25B 49/022* (2013.01); *F25B 7/00* (2013.01); *F25B 40/02* (2013.01); *F25B 41/04* (2013.01);
(Continued)

(58) Field of Classification Search
CPC ..... F25B 49/022; F25B 41/04; F25B 7/00; F25B 40/02; F25B 2600/02; F25B 2600/21; F25B 2500/05
See application file for complete search history.

(56) References Cited

U.S. PATENT DOCUMENTS 4,084,388 A 4/1978 Nelson
4,628,700 A 12/1986 Alsenz
(Continued)

FOREIGN PATENT DOCUMENTS

DE 102006050232 B3 2/2008
EP 1775528 A1 4/2007
(Continued)

OTHER PUBLICATIONS

International Search Report for application PCT/EP2012/057812, dated Mar. 1, 2013, 4 pages.
(Continued)

*Primary Examiner* — Kun Kai Ma
(74) *Attorney, Agent, or Firm* — Cantor Colburn LLP

(57) ABSTRACT

A cooling system comprises a refrigeration circuit (1) circulating a refrigerant and comprising in the flow direction of the refrigerant at least one compressor (2*a*, 2*b*, 2*c*, 2*d*); at least one condenser (4); at least one expansion device (8, 10); and at least one evaporator (11) for providing a cooling capacity. The cooling system further comprises a subcooling circuit (20) for subcooling the refrigerant circulating in the refrigeration circuit (1), the subcooling circuit (20) being configured to circulate a subcooling refrigerant and comprising at least one subcooler compressor (22, 23); at least one heat exchange means (6, 7) being arranged downstream of the at least one condenser (4) and being configured for heat exchange between the refrigeration circuit (1) and the subcooling circuit (20), the at least one heat exchange means (6, 7) comprising at least one temperature sensor; and a control unit (15) which is configured for controlling at least one compressor (2*a*, 2*b*, 2*c*, 2*d*) of the refrigeration circuit (1) and at least one subcooler compressor (22, 23) of the subcooling circuit (20) such that the cooling capacity to be provided by the at least one evaporator (11) is met and such
(Continued)

that the temperature at the at least one heat exchange means (6, 7) measured by at least one temperature sensor is in a predetermined range.

22 Claims, 3 Drawing Sheets

(51) Int. Cl.
*F25B 41/04* (2006.01)
*F25B 49/02* (2006.01)

(52) U.S. Cl.
CPC ..... *F25B 49/02* (2013.01); *F25B 2400/075* (2013.01); *F25B 2400/13* (2013.01); *F25B 2500/05* (2013.01); *F25B 2600/02* (2013.01); *F25B 2600/19* (2013.01); *F25B 2600/21* (2013.01); *F25B 2700/21162* (2013.01); *F25B 2700/21163* (2013.01)

(56) References Cited

U.S. PATENT DOCUMENTS

| | | | | |
|---|---|---|---|---|
| 4,825,662 | A | 5/1989 | Alsenz | |
| 4,940,079 | A | 7/1990 | Best et al. | |
| 5,214,930 | A | 6/1993 | Bendtsen | |
| 5,386,709 | A * | 2/1995 | Aaron | F25B 5/02 62/199 |
| 5,440,891 | A | 8/1995 | Hindmon, Jr. et al. | |
| 5,440,894 | A | 8/1995 | Schaeffer et al. | |
| 5,743,098 | A | 4/1998 | Behr | |
| 5,755,104 | A * | 5/1998 | Rafalovich | F25B 13/00 62/205 |
| 5,921,092 | A * | 7/1999 | Behr | A47F 3/0482 62/155 |
| 6,095,427 | A | 8/2000 | Hoium et al. | |
| 6,460,355 | B1 * | 10/2002 | Trieskey | F25B 5/02 62/175 |
| 6,983,618 | B2 | 1/2006 | Singh et al. | |
| 7,617,695 | B2 | 11/2009 | Shapiro | |
| 7,797,957 | B2 | 9/2010 | Sunderland | |
| 2004/0148956 | A1 * | 8/2004 | Arshansky | F25B 9/008 62/335 |
| 2005/0244277 | A1 * | 11/2005 | Hurst, Jr. | F04B 49/065 417/216 |
| 2008/0078203 | A1 * | 4/2008 | Duraisamy | F25B 1/10 62/510 |
| 2009/0019861 | A1 * | 1/2009 | Heckt | B60H 1/005 62/3.2 |
| 2009/0120117 | A1 * | 5/2009 | Martin | F25B 7/00 62/246 |
| 2009/0133412 | A1 | 5/2009 | Narayanamurthy | |
| 2009/0272128 | A1 * | 11/2009 | Ali | F25B 7/00 62/56 |
| 2010/0031697 | A1 * | 2/2010 | Hinde | F25B 7/00 62/498 |
| 2010/0094434 | A1 | 4/2010 | Ballet et al. | |
| 2010/0300135 | A1 * | 12/2010 | Otake | F24D 17/02 62/335 |
| 2012/0042674 | A1 * | 2/2012 | Takenaka | F24F 3/06 62/180 |

FOREIGN PATENT DOCUMENTS

| | | | |
|---|---|---|---|
| EP | 2261570 | A2 | 12/2010 |
| GB | 2273763 | A | 6/1994 |
| JP | S6096849 | A | 5/1985 |
| JP | 2008267732 | A | 11/2008 |
| KR | 20010079061 | A | 8/2001 |

OTHER PUBLICATIONS

Written Opinion for application PCT/EP2012/057812, dated Mar. 1, 2013, 7 pages.

* cited by examiner

COOLING SYSTEM

Refrigeration circuits comprising in the direction of the flow of a circulating refrigerant at least one compressor, a heat rejecting heat exchanger, an expansion device and an evaporator are known in the state of the art. It is also known to provide an additional economizer circuit for further cooling ("subcooling") the refrigerant leaving the heat rejecting heat exchanger before expanding it in order to increase the efficiency of the refrigeration circuit. Such refrigeration circuits, however, require a lot of energy which is delivered by the compressor(s).

Accordingly it would be beneficial to increase the efficiency of such refrigeration circuits.

Exemplary embodiments of the invention include a cooling system comprising a refrigeration circuit circulating a refrigerant and comprising in the flow direction of the refrigerant at least one compressor; at least one condenser; at least one expansion device; and at least one evaporator for providing a cooling capacity; the cooling system further comprising a subcooling circuit for subcooling the refrigerant circulating in the refrigeration circuit, the subcooling circuit being configured to circulate a subcooling refrigerant and comprising at least one subcooler compressor; at least one heat exchange means being arranged downstream of the at least one condenser and being configured for heat exchange between the refrigeration circuit and the subcooling circuit, the at least one heat exchange means comprising at least one temperature sensor; and a control unit which is configured for controlling at least one compressor of the refrigeration circuit and at least one subcooler compressor of the subcooling circuit such that the cooling capacity to be provided by the at least one evaporator is met and such that the temperature at the at least one heat exchange means measured by at least one temperature sensor is in a predetermined range.

Exemplary embodiments of the invention further include a method of controlling the operation of the cooling system comprising a refrigeration circuit which is configured for circulating a refrigerant and comprises in the direction of flow of the refrigerant at least one compressor; at least one condenser; at least one expansion device; and at least one evaporator; the cooling system further comprising: a subcooling circuit for subcooling the refrigerant circulating in the refrigeration circuit, the subcooling circuit being configured to circulate a subcooling refrigerant and comprising at least one subcooler compressor; at least one heat exchange means being arranged downstream of the at least one condenser and being configured for heat exchange between the refrigeration circuit and the subcooling circuit, the at least one heat exchange means comprising at least one temperature sensor; and wherein the method includes to control at least one compressor of the refrigeration circuit and at least one subcooler compressor of the subcooling circuit such that the cooling capacity to be provided by the at least one evaporator is met and such that the temperature at the at least one heat exchange means measured by at least one temperature sensor is in a predetermined range.

Exemplary embodiments of the invention are described in greater detail below with reference to the figures, wherein.

Figure 1:
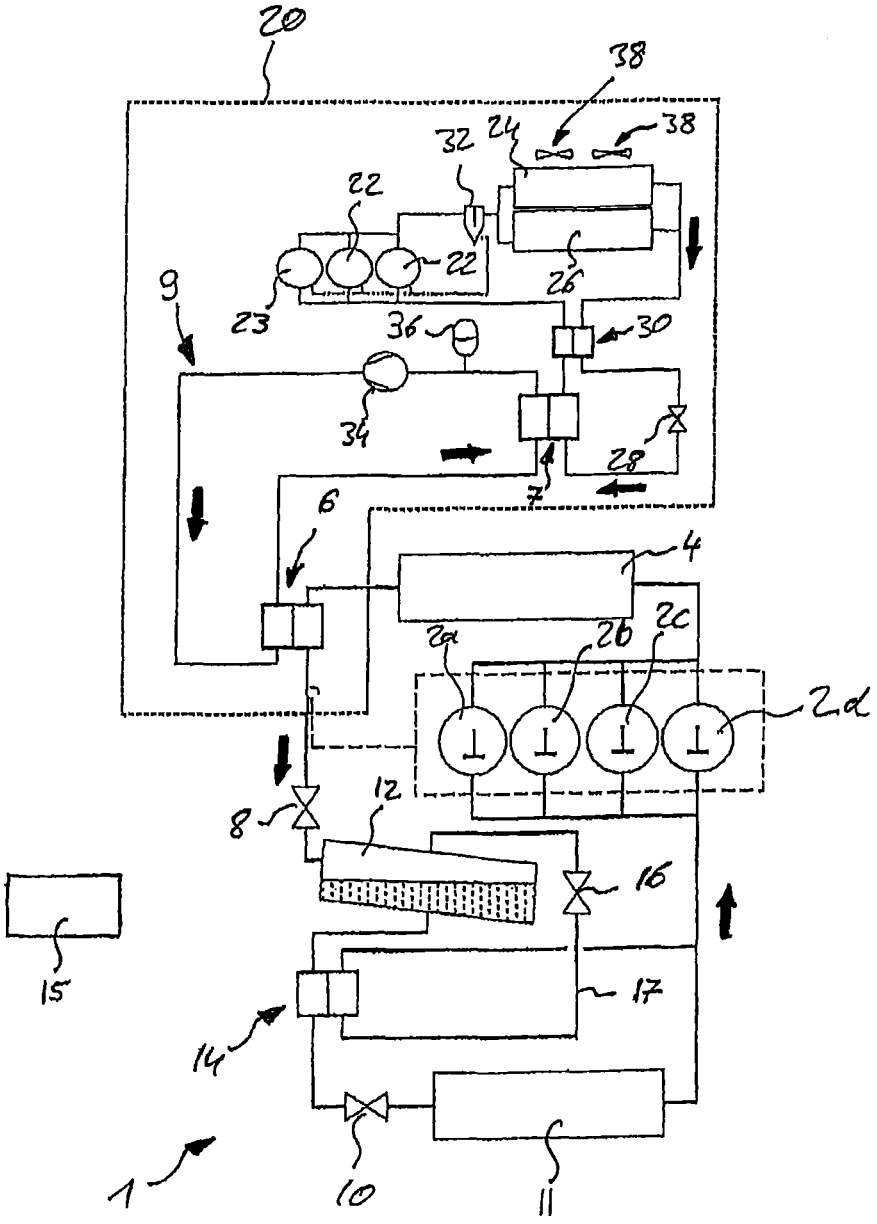
FIG. 1 shows a schematic view of a cooling system comprising a refrigeration circuit and a subcooling circuit.

FIG. 1 shows a schematic view of an exemplary embodiment of a cooling system having a refrigeration circuit 1 comprising in the direction of the flow of a refrigerant, which is circulating within the refrigeration circuit 1 as indicated by the arrows, a set of compressors 2*a*, 2*b*, 2*c*, 2*d* connected in parallel to each other, a condenser gas cooler 4 connected to the high pressure outlet sides of the compressors 2*a*, 2*b*, 2*c*, 2*d*, an economizer heat exchanger 6, a high pressure expansion device 8, a refrigerant collector 12, a medium pressure expansion device 10, and an evaporator 11. The outlet side of the evaporator 11 is connected to the suction (inlet) side of the compressors 2*a*, 2*b*, 2*c*, 2*d*. Thus, the exemplary embodiment of a refrigeration circuit 1 shown in FIG. 1 comprises a one-stage compression by means of the compressors 2*a*, 2*b*, 2*c*, 2*d* connected in parallel and a two-stage expansion by successive expansions by means of the high pressure expansion device 8 and the medium pressure expansion device 10.

A flash gas tapping line 17 connects an upper portion of the refrigerant collector 12 to the inlet side of the compressors 2*a*, 2*b*, 2*c*, 2*d* allowing flash gas collecting in an upper portion of the refrigerant collector 12 to bypass the evaporator 11. A flash gas expansion device 16 is arranged in the flash gas tapping line 17 in order to expand the flash gas delivered from the refrigerant collector 12. Downstream of said flash gas expansion device 16 a flash gas heat exchanger 14 can be provided in order to cool the expanded flash gas by means of heat exchange with the refrigerant flowing from the refrigerant collector 12 to the low pressure expansion device 10.

The economizer heat exchanger 6 is coupled to a fluid cycle 9 further comprising a subcooler heat exchanger 7, a fluid reservoir 36 and a fluid pump 34, which is configured for circulating a heat transfer fluid, especially water, within the fluid cycle 9.

The subcooler heat exchanger 7 is part of a subcooler refrigeration circuit 20, comprising in the direction of the flow of a subcooler refrigerant, as indicated by the arrows, a set of subcooler compressors 22, 23 connected in parallel to each other, at least one of said subcooler compressors 22, 23 being a variable speed compressor 23, an oil separator 32 for separating oil from the refrigerant leaving the subcooler compressors 22, 23, two subcooler condensers 24, 26 connected in parallel to each other, and a subcooler expansion device 28 which is configured for expanding the subcooler refrigerant delivered from the subcooler condensers 24, 26 before it is fed back into the subcooler heat exchanger 7. After the heat exchange in the subcooler heat exchanger 7, the subcooler refrigerant is led to subcooler compressors 22, 23.

An optional further heat exchanger 30 thermally connecting the inlet line of the subcooler expansion device 28 to the outlet line of the subcooler heat exchanger 7 allows to enhance the efficiency of the subcooler refrigeration circuit 20 by cooling the subcooler refrigerant delivered from the subcooler heat exchanger 7 before it is compressed by the subcooler compressors 22, 23.

In operation the refrigerant leaving the condenser 4 of the refrigeration circuit 1 is expanded by means of the high pressure expansion device 8 from a high pressure level provided by the compressors 2*a*, 2*b*, 2*c*, 2*d* to an intermediate pressure level. Said medium pressurized refrigerant, which usually comprises a gas phase fraction and a liquid phase fraction, is collected in the refrigerant collector 12.

The liquid phase of the refrigerant collects at the bottom of the refrigerant collector 12 and is delivered to the medium pressure expansion device 10 where it expands before entering the evaporator 11 for evaporation. During evaporation in the evaporator 11 the refrigerant absorbs heat thereby cooling the evaporator's 11 environment, e. g. a refrigerating sales furniture or an air conditioning system.

The evaporated refrigerant leaving the evaporator 11 is delivered to the inlet sides of the compressors 2*a*, 2*b*, 2*c*, 2*d*, the compressors 2*a*, 2*b*, 2*c*, 2*d* compress the refrigerant to high pressure again and deliver the highly pressurized refrigerant to the condenser 4 where it is cooled against the condenser's 4 environment, e.g. ambient air, and at least partially condensed.

The ratio of the gas phase fraction and the liquid phase fraction of the refrigerant exiting the condenser 4 varies depending on various factors including the ambient temperature at the condenser 4, the cooling capacity delivered by the evaporator 11, and the performance of the compressors 2*a*, 2*b*, 2*c*, 2*d*. As the gas fraction of the refrigerant is of no use for cooling the evaporator 11, a large gas fraction within the refrigerant leaving the condenser 4 reduces the performance of the refrigeration circuit 1. It is therefore desirable to reduce the ratio of the gas phase fraction comprised in the refrigerant delivered from the condenser 4 to the high pressure expansion device 8.

In order to reduce the ratio of the gas phase fraction comprised in the refrigerant leaving the condenser 4, the refrigerant delivered from the condenser 4 is cooled within the economizer heat exchanger 6 by transferring heat from the refrigerant circulating within the refrigeration circuit 1 to a heat transfer fluid circulating in the fluid cycle 9 coupled to the economizer heat exchanger 6, which condenses and therefore reduces the gas phase fraction of the refrigerant.

The heat transfer fluid circulating in the fluid cycle 9 itself is cooled by means of the subcooling cycle 20, which works according to similar principles as the refrigeration circuit 1.

Enhancing the subcooling of the refrigerant in the economizer heat exchanger 6 by increasing the performance of the subcooling cycle 20 reduces the ratio of the gas phase fraction comprised in the refrigerant leaving the economizer heat exchanger 6, which results in an enhanced efficiency of the refrigeration circuit 1. On the other hand, in order to increase the performance of the subcooling circuit 20, more power is needed for operating the subcooler compressors 22, 23, which counteracts the effect of enhancing the efficiency of the refrigeration circuit 1 by subcooling.

It is therefore desirable to operate the cooling system so that the combined efficiency of the refrigeration circuit 1 and the subcooling cycle 20, i.e. the ratio of the cooling capacity provided by the refrigeration circuit 1 with respect to the accumulated power consumption of both, the compressors 2*a*, 2*b*, 2*c*, 2*d* of the refrigeration circuit 1 and the subcooler compressors 22, 23, is at or at least close to its maximum. As the ambient temperature at the condenser/gascooler 4 is given and as the cooling capacity to be provided by the refrigeration circuit 1 is usually a predetermined quantity, which has to be met and cannot be changed, the optimal efficiency of the cooling system is to be achieved by adjusting the operation of the compressors 2*a*, 2*b*, 2*c*, 2*d* of the refrigeration circuit 1 and the operation of the subcooler compressors 22, 23 accordingly.

It has been found that this can be achieved by controlling the compressors 2*a*, 2*b*, 2*c*, 2*d* of the refrigeration circuit 1 and the subcooler compressors 22, 23 of the subcooling circuit 20 such that the cooling capacity to be provided by the at least one evaporator 11 is met and such that the temperature at the heat exchanger 6 measured by at least one temperature sensor is in a predetermined range. The inventors have discovered that the heat transfer at the heat exchanger 6 has a large impact on the overall energy efficiency of the overall cooling system comprising the refrigeration circuit 1 and the subcooling circuit 20. Further, the optimum heat transfer at the heat exchanger 6 where the overall cooling system comprising the refrigeration circuit 1 and the subcooling circuit 20 reaches the maximum overall energy efficiency is dependent on the outdoor/ambient temperature. Therefore the inventors have made the finding that the temperature of the heat transfer fluid entering the heat exchanger 6 has to be controlled depending on the load of the refrigeration circuit 1, which in turn is dependent from the cooling capacity which has to be provided by the evaporator 11.

In one embodiment, at least one temperature sensor (not shown) is provided to measure the temperature of the refrigerant leaving the heat exchanger 6, and the control unit 15 controls the compressors 2*a*, 2*b*, 2*c*, 2*d* of the refrigeration circuit 1 and/or the subcooler compressor 22, 23 of the subcooling circuit 20 so that the temperature of the refrigerant leaving the heat exchanger 6 is in a range of 5° C. to 15° C. and in particular in a range of 9° C. to 11° C. This has been found to be a particularly efficient operation.

In another embodiment, at least one temperature sensor is provided to measure the temperature of the subcooling refrigerant entering the heat exchanger, and the control unit 15 controls the compressors 2*a*, 2*b*, 2*c*, 2*d* of the refrigeration circuit 1 and/or the subcooler compressors 22, 23 of the subcooling circuit 20 so that the temperature of the subcooling refrigerant entering the subcooler heat exchanger 7 is in the range of 1° C. to 10° C. and in particular in a range of 3° C. to 5° C.

It has further been found that the overall efficiency of the cooling system is close to its maximum when the compressors 2*a*, 2*b*, 2*c*, 2*d* of the refrigeration circuit 1 run in a range of 40% to 90% of their maximum performance and the liquid ratio of the refrigerant leaving the economizer heat exchanger 6 is close to 85% at approximately 10° C. In this case, the temperature of the subcooling refrigerant entering the subcooler heat exchanger 7 is approximately 4° C. and the temperature of the fluid entering the economizer heat exchanger 6 is approximately 7° C.

Thus, a control unit 15, which is provided for controlling the operation of the compressors 2*a*, 2*b*, 2*c*, 2*d* of the refrigeration circuit 1 as well as the operation of the subcooler compressors 22, 23, is configured to operate the cooling system at or at least close to said temperature setpoints. The control unit 15 is supplied with the necessary actual temperatures of the refrigerants and the fluid entering and leaving the heat exchangers by means of temperature sensors, which are attached to the heat exchangers 6, 7 but not explicitly shown in the figures.

Providing a fluid circuit 9 for coupling the economizer heat exchanger 6 with the subcooling heat exchanger 7, as shown in FIG. 1, is optional. In an alternative embodiment, which is not shown in the figures, the economizer heat exchanger 6 and the subcooling heat exchanger 7 may be combined in a single heat exchanger directly coupling the refrigeration circuit 1 to the subcooling circuit 20 without providing an intermediate fluid circuit 9. By combining the heat exchangers 6, 7 in a single heat exchanger the costs for providing the additional fluid circuit 9 may be saved.

However, as the heat transfer rate between a heat transfer fluid circulating within the fluid circuit 9 and the refrigerant circulating within the refrigeration circuit 1 or the subcooling circuit 20, respectively, may be larger than the direct heat transfer rate between both refrigerants, providing a fluid circuit 9 may help to increase the efficiency of the heat transfer from the refrigeration circuit 1 to the subcooling circuit 20. In addition, the heat transfer fluid circulating within the fluid circuit 9 may be used for further purposes, e.g. for operating a heating and/or air conditioning system.

Figure 2:
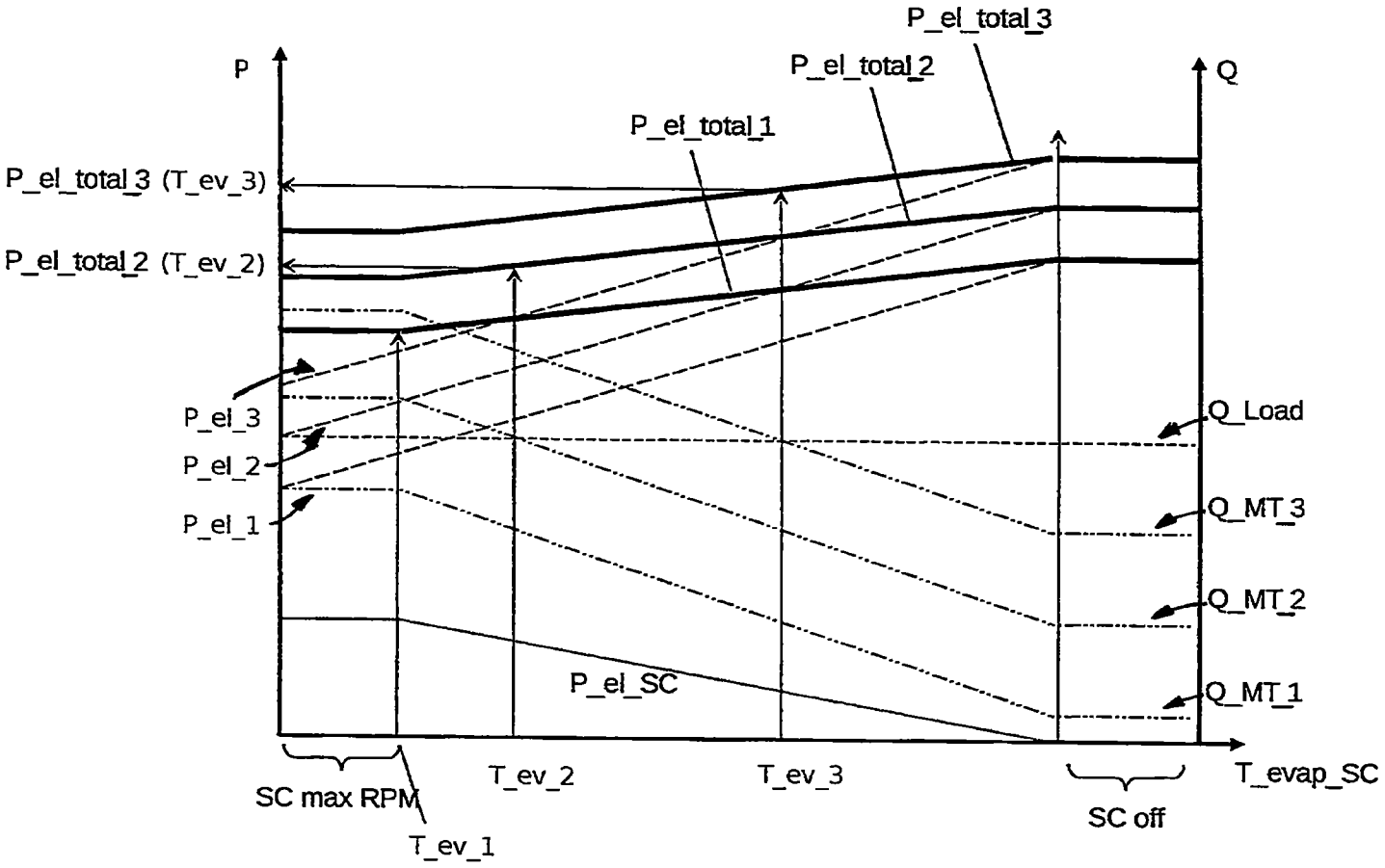
FIG. 2 shows a diagram illustrating the physical basics for controlling a cooling system according to an exemplary embodiment of the invention.

The physical basics of controlling a cooling system according to an exemplary embodiment of the invention are described with respect to the diagram shown in FIG. 2.

The horizontal axis of the diagram denoted with "T-evap_SC" shows the temperature of the subcooler refrigerant at the subcooler heat exchanger 7, which is a function of the performance of the subcooler compressors 22, 23.

The left-hand side vertical axis shows the power P needed for operating the compressors 2*a*, 2*b*, 2*c*, 2*d* and the subcooler compressors 22, 23, respectively, and the right-hand side vertical axis shows the cooling capacity Q provided by the cooling system.

Line P_el_SC in the lower portion of the diagram indicates the (electrical) power supplied for operating the subcooler compressors 22, 23. It decreases from left to right when the refrigerant temperature T_ev at the subcooler heat exchanger 7 increases as an decreased performance of the subcooler compressors 22, 23, which results in an decreased power consumption, results in a increase of the temperature of the subcooler refrigerant and vice versa. In the most left portion of the diagram, indicated by "SC max RPM", the subcooler compressors 22, 23 are running at their maximum speed and in the most right portion, indicated by "SC off", the subcooler compressors 22, 23 are switched off.

The three dashed raising lines P_el_1, P_el_2, P_el_3 shown in an upper portion of the diagram respectively denote the power needed for operating the compressors 2*a*, 2*b*, 2*c*, 2*d* of the refrigeration cycle 1 when one, two or three of the compressors 2*a*, 2*b*, 2*c*, 2*d* are running, and the bold solid lines P_el_total_1, P_eltotal_2, P_el_total_3 at the top of the diagram respectively denote the corresponding sums of P_el_SC and the respective P_el_1, P_el_2, P_el_3:

$$P_el_\text{total}_x = P_el_x + P_el_SC.$$

The dashed horizontal line Q_Load shown in the middle of the diagram indicates the (predetermined) cooling capacity to be provided at the evaporator 11. The dotted-and-dashed lines Q_MT_1, Q_MT_2, Q_MT_3 respectively indicate the cooling capacity provided at the evaporator 11 for different numbers of operating compressors 2*a*, 2*b*, 2*c*, 2*d*.

Thus, the cooling systems meets the predetermined cooling demands at those points of operation at which one of the dotted-dashed lines Q_MT_1, Q_MT_2, Q_MT_3 intersects with the dashed horizontal line Q_Load.

The diagram shows that it is not possible to meet the cooling requirements Q_Load if only one of the compressors 2*a*, 2*b*, 2*c*, 2*d* of the refrigeration system 1 is operating, as Q_MT_1 never matches with the dashed horizontal line Q_Load.

The cooling requirements, however, can be met when two or three of the compressors 2*a*, 2*b*, 2*c*, 2*d* are operating, as lines Q_MT_2 and Q_MT_3 intersect line Q_Load at T_evap_SC=T_ev_2 and T_evap_SC=T_ev_3, respectively.

The total power consumption P_el_total_3 at T_ev=T_ev_3, when three compressors 2*a*, 2*b*, 2*c* running, is higher than the total power consumption P_el_total_2 at T_ev=T_ev_2, when two compressors 2*a*, 2*b* are running. Thus, operating two compressors 2*a*, 2*b* and adjusting the operation of the subcooler circuit 20 so that the temperature T_evap_SC at the subcooler heat exchanger 7 is equal to T_ev_2 provides the most efficient way of providing the requested cooling capacity Q_Load.

Figure 3:
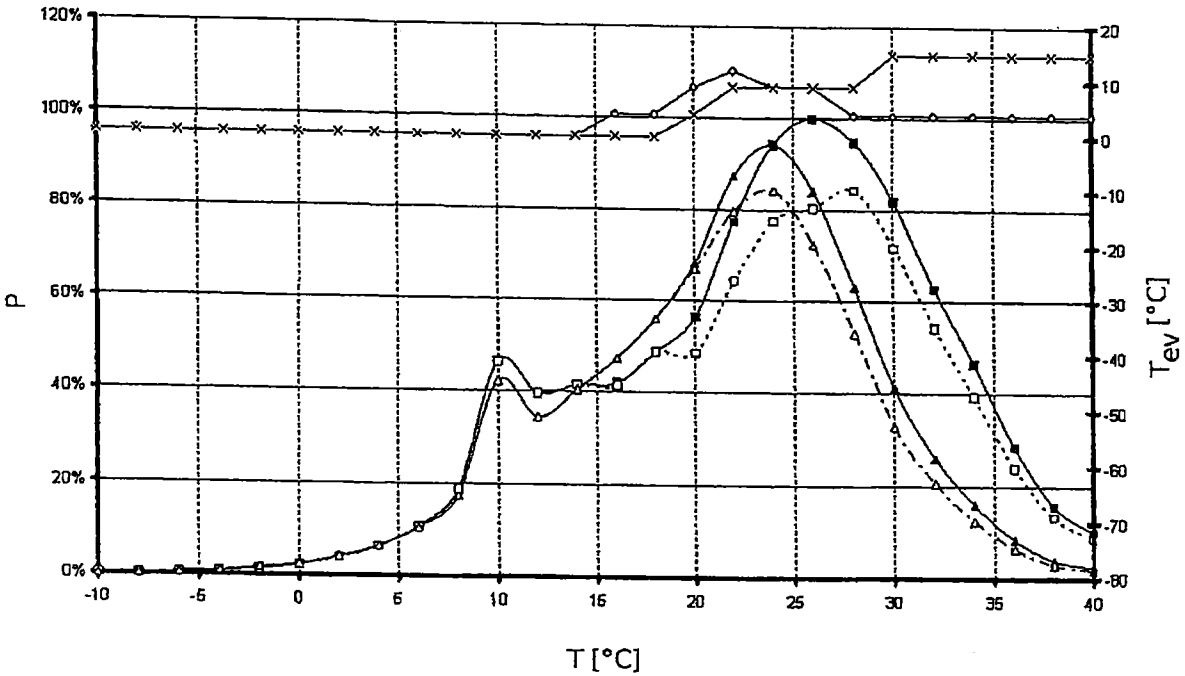
FIG. 3 shows a diagram illustrating the effects of operating a cooling system according to an exemplary embodiment of the invention.

FIG. 3 illustrates results of controlling the refrigeration circuit 1 and the subcooling circuit 20 according to an exemplary embodiment of the invention as described before.

The diagram shown in FIG. 3 illustrates in its upper portion the temperatures T_ev of the subcooler refrigerant at the subcooler heat exchanger 7 (right-hand side vertical axis) as a function of the environmental (in particular outdoor) temperature T (horizontal axis) for a typical mode of operation during the day, indicated by the diamonds, and during the night, indicated by the stars, as it results from the control of the refrigeration circuit 1 and the subcooling circuit 20 according to an exemplary embodiment of the invention as it has been described before.

During the day (diamonds), the temperature T_ev at the subcooler heat exchanger 7 is constant at 0° C. as long as the environmental (outdoor) temperature T is below 18° C. At environmental temperatures T above 18° C. the temperature T_ev at the subcooler heat exchanger 7 raises up to approximately 10° C. at T=22° C. and then drops back to temperatures of approximately 3° C. for environmental temperatures of T=28° C. and more.

During the night (stars), the temperature T_ev at the subcooler heat exchanger 7 is constant at 0° C. as long as the environmental (outdoor) temperature T is below 18° C. At environmental temperatures T above 18° C. the temperature T_ev at the subcooler heat exchanger 7 raises up to approximately 10° C. at T=22° C. and keeps constant at said value up to environmental temperatures T of approximately 28° C. When the environmental temperature T raises even further, the temperature T_ev at the subcooler heat exchanger 7 raises to approximately 15° C. where it remains constant for environmental temperatures T in the range of 30° C. to 40° C.

The lower portion of the diagram shown in FIG. 3 illustrates the corresponding energy consumptions P (left-hand side vertical axis) for a conventional cooling system (straight lines) and for a cooling system according to an exemplary embodiment of the invention (dotted line and dashed-and-dotted line) in day and night operation, respectively.

The conventional system (straight lines) reaches its maximum power consumption P_max (100%) at an environmental temperature T of approximately 26° C. in day operation (filled squares) and a slightly less power consumption at an outdoor temperature of approximately 24° C. in night operation (filled triangles).

In a cooling system according to an exemplary embodiment of the invention the maximum power consumption P_max is also reached at an outdoor temperature of 24° C. in night operation (open triangles).

However in day operation (open squares) the maximum power consumption P-max will be reached at a slightly higher outdoor temperature of about 28° C.

As can be seen by comparing the maximum valves of the graphs power consumption day operation conventional system (filled squares) and maximum power consumption day operation cooling system according to an exemplary embodiment of the invention (open squares), the maximum power consumption P_max of a cooling system according to an exemplary embodiment of the invention is at approximately 83% of the maximum power consumption P_max=100% of a conventional cooling system and therefore considerably reduced.

As can be seen by comparing the maximum valves of the graphs power consumption night operation conventional system (filled triangles) and maximum power consumption night operation cooling system according to an exemplary embodiment of the invention (open triangles), the maximum power consumption P_max of a cooling system according to an exemplary embodiment of the invention at night operation is at approximately 83% of the maximum power consumption P_max=100%, while the maximum power consumption P_max of a conventional cooling system at night operation is at approximately 95% of the maximum power consumption P_max=100%. Therefore the maximum power consumption P_max of a cooling system according to an exemplary embodiment of the invention is considerable reduced at night operation as well.

According to exemplary embodiments of the invention, as described herein, the at least one compressor of the refrigeration circuit and at least one subcooler compressor of the subcooling circuit are controlled such that the cooling capacity to be provided by the at least one evaporator is met and such that the temperature at the at least one heat exchange means measured by at least one temperature sensor is in a predetermined range.

Thereby, a cooling system which significantly improves efficiency and a considerable reduction of the overall energy needed for operating the cooling system can be obtained.

The predetermined range of the temperature at the at least one heat exchange means can change over time based on e.g. varying outdoor/ambient temperatures or a varying cooling capacity to be provided by the evaporator(s).

By such control, the amount of heat transferred from the refrigeration circuit to the subcooling circuit can be adjusted, taking into account the necessary cooling capacity that has to be provided and the outdoor/ambient temperature.

Further tests have shown that by using an optimized heat transfer to the subcooling system according to exemplary embodiments of the invention in an $CO_2$-based cooling system, the energy efficiency of conventional R404A standard systems may be reached. Thus, the invention allows to switch from R404A-based systems to $CO_2$-based cooling systems without losing efficiency.

The evaporation temperature in the heat exchange means can be increased depending on the conditions in the refrigeration system in an optimum way. The refrigeration system provides a signal to indicate the status of the running compressors. The heat exchange means can make use of this signal to increase or decrease the evaporating temperature to fit the best overall power consumption.

According to exemplary embodiments of the invention, as described herein, the refrigeration circuit and the subcooling circuit are controlled such that the efficiency of the cooling system, i.e. the ratio of the cooling capacity provided by the system with respect to the total amount of power needed to operate the compressors of the refrigeration cycle as well as of the subcooling cycle, is at or at least close to its maximum.

In a first embodiment, at least one temperature sensor is provided to measure the temperature of the refrigerant leaving the heat exchange means, and at least one compressor of the refrigeration circuit and/or at least one subcooler compressor of the subcooling circuit are controlled such that so that the temperature of the refrigerant leaving the heat exchange means is in a range of 5° C. to 15° C. and in particular in a range of 9° C. to 11° C. It has been found that such temperature range results in a very efficient operation of the cooling system.

In a further embodiment, at least one temperature sensor is provided to measure the temperature of the subcooling refrigerant entering the heat exchange means, and at least one compressor of the refrigeration circuit and/or at least one subcooler compressor of the subcooling circuit are controlled such that the temperature of the subcooling refrigerant entering the subcooler heat exchange means is in the range of 1° C. to 10° C. and in particular in a range of 3° C. to 5° C. It has been found that operating the subcooling circuit within said temperature range results in a very efficient operation of the cooling system.

In a further embodiment, the refrigeration circuit and the subcooling circuit are controlled such that the compressor(s) of the refrigeration circuit operate at 40% to 90% of their maximum capacity. It has been found that operating the compressors at 40% to 90% of their maximum capacity results in a very efficient operation of the cooling system.

In a further embodiment, the subcooling circuit is controlled such that the refrigerant leaving the heat exchange means comprises at least 85% of liquid refrigerant. Providing at least 85% of liquid refrigerant results in an very efficient operation of the cooling system.

In a further embodiment, the control unit is configured to run the minimum number of compressors of the refrigeration circuit and to run at least one subcooler compressor of the subcooling circuit so that the cooling capacity to be provided by the at least one evaporator is met and so that the overall power consumption is minimized. This provides a very efficient operation of the cooling system.

In a further embodiment, the control unit is configured to selectively switch on and off at least one of the compressors of the refrigeration circuit depending how much cooling capacity is to be provided by the at least one evaporator. Switching on and off at least one of the compressors provides an easy and efficient way of controlling the operation of the refrigeration circuit.

In a further embodiment, at least one subcooler compressor of the subcooling circuit is operable at variable speed and the control unit is configured to continuously adjust the speed of said subcooler compressor and/or wherein at least one of the compressors of the refrigeration circuit is operable at variable speed and wherein the control unit is configured to continuously control the speed of said compressor. This allows a very fine control of the performance of the subcooling circuit and the refrigeration circuit.

In a further embodiment, the subcooling circuit further comprises at least one subcooler condenser; and at least one subcooler expansion device.

In a further embodiment, the heat exchange means is a heat exchanger coupling the refrigeration circuit with the subcooling circuit. In this embodiment, a direct heat exchange between the refrigeration circuit and the subcooling circuit is obtained.

In a further embodiment, the heat exchange means is formed as a fluid circuit coupling the refrigeration circuit with the subcooling circuit, said fluid circuit being coupled to the refrigeration circuit by means of the at least one heat exchanger being arranged downstream of the at least one condenser and being coupled to the subcooling circuit by means of a subcooler heat exchanger. The fluid circuit can also be called brine loop. In this embodiment, an indirect heat exchange relationship between the refrigeration circuit and the subcooling circuit is obtained by means of the fluid circuit, by means of the at least one heat exchanger, and by means of the subcooler heat exchanger. In the fluid circuit a heat transfer fluid is circulated. A heat transfer fluid circulating between the heat exchangers may improve the heat transfer rate within the heat exchangers. In addition, the circulating heat transfer fluid may be used to transfer heat for additional purposes, e.g. for the operation of a heating and/or cooling system.

In a further embodiment, the heat exchange means further comprises a fluid pump and/or a fluid reservoir and wherein the fluid circulated in the fluid circuit comprises water. In an embodiment the fluid circuit comprises a fluid pump and/or a fluid reservoir. Providing a fluid pump and/or a fluid reservoir allows an efficient and reliable operation of the fluid circuit. Water provides a cheap and non-toxic heat transfer fluid which is easy to handle and harmless with respect to the environment.

In a further embodiment, a second expansion device is arranged downstream of the first expansion device in order to provide a two-stage expansion. A two-stage expansion may increase the efficiency of the cooling system.

In a further embodiment, the refrigeration circuit further comprises a refrigerant collector, in order to collect and store the refrigerant. In one embodiment the refrigerant collector is arranged between the first and second expansion devices in order to collect the partially expanded refrigerant.

In a further embodiment, the refrigeration circuit further comprises a flash gas tapping line connecting an upper portion of the refrigerant collector to the inlet side of the at least one compressor in order to bypass the evaporator. In an embodiment the flash gas tapping line comprises a flash gas expansion device and/or a flash gas heat exchanger which is configured for heat exchange of the flash gas with the refrigerant delivered to the evaporator. Providing a flash gas tapping line, a flash gas expansion device and/or a flash gas heat exchanger helps to increase the efficiency of the cooling system even further.

In a further embodiment, the subcooling circuit is configured to circulate a subcooling refrigerant and comprises in the direction of flow of the subcooling refrigerant at least one subcooler compressor, at least one subcooler condenser, at least one subcooler expansion device, and at least one subcooler heat exchanger. The subcooler heat exchanger is formed by the heat exchanger, case of the configuration of the cooling system where the heat exchange means is formed by a heat exchanger coupling the refrigeration circuit directly with the subcooling circuit, or by the subcooler heat exchanger of the heat exchange means, in case of the configuration of the cooling system where the heat exchange means is formed as a fluid circuit coupling the refrigeration circuit with the subcooling circuit, said fluid circuit being coupled to the refrigeration circuit by means of the at least one heat exchanger being arranged downstream of the at least one condenser and being coupled to the subcooling circuit by means of a subcooler heat exchanger. A subcooling circuit which is configured to circulate a refrigerant provides an efficient and reliable subcooling circuit which is easy to control.

In a further embodiment, the refrigerant and/or the subcooling refrigerant comprises $CO_2$. $CO_2$ provides a well-suited non-toxic and environmentally beneficial refrigerant.

The skilled person will recognize that a deep-freezing circuit for providing even lower (deep-freezing) temperatures may be combined with the refrigeration circuit shown in FIG. 1, as it is known in the state of the art.

While the invention has been described with reference to exemplary embodiments, it will be understood by those skilled in the art that various changes may be made and equivalents may be substituted for elements thereof without departing from the scope of the invention. In addition, many modifications may be made to adapt the particular situation or material to the teachings of the invention without departing from the essential scope thereof. Therefore it is intended that the invention not be limited to the particular embodiments disclosed, but that the invention will include all embodiments falling within the scope of the appended claims.

REFERENCE NUMERALS

1 refrigeration circuit
2*a*, 2*b*, 2*c*, 2*d* compressors
4 condenser
6 economizer heat exchanger
7 subcooler heat exchanger
8 high pressure expansion device
9 fluid circuit
10 medium pressure expansion device
11 evaporator
refrigerant collector
12 flash gas heat exchanger
14 control unit
16 flash gas expansion device
17 flash gas tapping line
20 subcooling circuit
22, 23 subcooler compressors
24, 26 subcooler condensers
28 subcooler expansion device
30 further heat exchanger
34 fluid pump
36 fluid reservoir

The invention claimed is:

1. A cooling system comprising:

a refrigeration circuit circulating a refrigerant and comprising in the flow direction of the refrigerant:

at least one compressor;

at least one condenser;

at least one expansion device; and at least one evaporator for providing a cooling capacity;

the cooling system further comprising:

a subcooling circuit for subcooling the refrigerant circulating in the refrigeration circuit, the subcooling circuit being configured to circulate a subcooling refrigerant and comprising at least one subcooler compressor;

at least one heat exchange means being arranged downstream of the at least one condenser and being configured for heat exchange between the refrigeration circuit and the subcooling circuit, the at least one heat exchange means comprising at least one temperature sensor; and a controller which is configured for controlling the at least one compressor of the refrigeration circuit and the at least one subcooler compressor of the subcooling circuit such that the cooling capacity to be provided by the at least one evaporator is met and such that the temperature at the at least one heat exchange means measured by at least one temperature sensor is in a predetermined range;

wherein the controller is configured to run a minimum number of the at least one compressor of the refrigeration circuit and to run the at least one subcooler compressor of the subcooling circuit so that the cooling capacity to be provided by the at least one evaporator is met and so that the overall power consumption is reduced.

2. The cooling system of claim 1, wherein the controller is configured to run the minimum number of the at least one compressor of the refrigeration circuit and to run at least one subcooler compressor of the subcooling circuit so that cooling capacity to be provided by the at least one evaporator is met and so that the overall power consumption is minimized.

3. The cooling system of claim 1, wherein the controller is configured to selectively switch on and off at least one of the at least one compressor of the refrigeration circuit depending on how much cooling capacity is to be provided by the at least one evaporator.

4. The cooling system of claim 1, wherein the at least one subcooler compressor of the subcooling circuit is operable at variable speed and wherein the controller is configured to continuously adjust the speed of said at least one subcooler compressor and/or wherein the at least one compressor of the refrigeration circuit is operable at variable speed and wherein the is configured to continuously control the speed of said at least one compressor.

5. The cooling system of claim 1, wherein the at least one temperature sensor is provided to measure the temperature of the refrigerant leaving the at least one heat exchange means, and wherein the controller is configured for controlling the at least one compressor of the refrigeration circuit and/or the at least one subcooler compressor of the subcooling circuit so that the temperature of the refrigerant leaving the at least one heat exchange means is in a range of 5° C. to 15° C. and in particular in a range of 9° C. to 11° C.

6. The cooling system of claim 1, wherein the at least one temperature sensor is provided to measure the temperature of the subcooling refrigerant entering the at least one heat exchange means, and wherein the controller is configured for controlling the at least one compressor of the refrigeration circuit and/or the at least one subcooler compressor of the subcooling circuit so that the temperature of the subcooling refrigerant entering the heat exchange means is in the range of 1° C. to 10° C. and in particular in a range of 3° C. to 5° C.

7. The cooling system of claim 1, wherein the controller is configured for controlling the at least one compressor of the refrigeration circuit such that the at least one compressor runs at 40% to 90% of maximum capacity.

8. The cooling system of claim 1, wherein the controller is configured for controlling the at least one compressor of the refrigeration circuit and the at least one subcooler compressor of the subcooling circuit so that the refrigerant leaving the at least one heat exchange means comprises at least 85% of liquid refrigerant.

9. The cooling system of claim 1, wherein the subcooling circuit further comprises at least one subcooler condenser; and at least one subcooler expansion device.

10. The cooling system of claim 1, wherein the at least one heat exchange means is a heat exchanger coupling the refrigeration circuit with the subcooling circuit.

11. The cooling system of claim 1, wherein a fluid circuit comprises the at least one heat exchange means coupling the refrigeration circuit with the subcooling circuit, said fluid circuit being coupled to the refrigeration circuit by at least one heat exchanger arranged downstream of the at least one condenser, said fluid circuit being coupled to the subcooling circuit by a subcooler heat exchanger.

12. The cooling system of claim 11, wherein the fluid circuit further comprises a fluid pump and/or a fluid reservoir and wherein the fluid circulated in the fluid circuit comprises water.

13. The cooling system of claim 1, wherein the at least one expansion device includes a second expansion device arranged downstream of a first expansion device and/or wherein the refrigeration circuit further comprises a refrigerant collector arranged upstream of the at least one evaporator, and/or wherein the refrigeration circuit further comprises a flash gas tapping line, connecting an upper portion of the refrigerant collector to the inlet side of the at least one compressor bypassing the evaporator, and/or wherein the flash gas tapping line comprises a flash gas expansion device, and/or wherein the flash gas tapping line comprises a flash gas heat exchanger which is configured for heat exchange between the flash gas and the refrigerant delivered to the at least one evaporator.

14. A method of controlling the operation of cooling system comprising a refrigeration circuit which is configured for circulating a refrigerant and comprises in the direction of flow of the refrigerant:

a controller;

at least one compressor;

at least one condenser;

at least one expansion device; and at least one evaporator;

the cooling system further comprising:

a subcooling circuit for subcooling the refrigerant circulating in the refrigeration circuit, the subcooling circuit being configured to circulate a subcooling refrigerant and comprising at least one subcooler compressor;

at least one heat exchange means being arranged downstream of the at least one condenser and being configured for heat exchange between the refrigeration circuit and the subcooling circuit, the at least one heat exchange means comprising at least one temperature sensor; and wherein the method includes using the controller to control the at least one compressor of the refrigeration circuit and the at least one subcooler compressor of the subcooling circuit such that the cooling capacity to be provided by the at least one evaporator is met and such that the temperature at the at least one heat exchange means measured by the at least one temperature sensor is in a predetermined range.

15. The method of claim 14, wherein a minimum number of the at least one compressor of the refrigeration circuit run and the at least one subcooler compressor of the subcooling circuit runs so that the cooling capacity to be provided by the at least one evaporator is met and so that the overall power consumption is minimized.

16. The method of claim 14, wherein a minimum number of the at least one compressor of the refrigeration circuit run and the at least one subcooler compressor of the subcooling circuit runs so that the cooling capacity to be provided by the at least one evaporator is met and so that the overall power consumption is reduced.

17. The method of claim 15, wherein the method includes to selectively switch on and off the at least one compressor of the refrigeration circuit depending how much cooling capacity is to be provided by the at least one evaporator.

18. The method of claim 14, wherein the at least one subcooler compressor of the subcooling circuit is operable at variable speed and the method includes to continuously adjust the speed of said at least one subcooler compressor and/or wherein the at least one compressor of the refrigeration circuit is operable at variable speed and the method includes to continuously control the speed of said at least one compressor of the refrigeration circuit.

19. The method of claim 14, wherein the temperature of the refrigerant leaving the at least one heat exchange means is measured, and wherein the at least one compressor of the refrigeration circuit and/or the at least one subcooler compressor of the subcooling circuit are controlled so that the temperature of the refrigerant leaving the at least one heat exchange means is in a range of 5° C. to 15° C. and in particular in a range of 9° C. to 11° C.

20. The method of claim 14, wherein the temperature of the subcooling refrigerant entering the heat exchanger is measured, and wherein the at least one compressor of the refrigeration circuit and/or the at least one subcooler compressor of the subcooling circuit are controlled so that the temperature of the subcooling refrigerant entering the at least one heat exchange means is in the range of 1° C. to 10° C. and in particular in a range of 3° C. to 5° C.

21. The method of claim 14, wherein the at least one compressor of the refrigeration circuit is controlled to run at 40% to 90% of maximum capacity.

22. The method of claim 14, wherein the at least one compressor of the refrigeration circuit and the at least one subcooler compressor of the subcooling circuit is controlled so that the refrigerant leaving the at least one heat exchange means comprises at least 85% of liquid refrigerant.

* * * * *